US008235383B2

(12) United States Patent
Masaki et al.

(10) Patent No.: US 8,235,383 B2
(45) Date of Patent: Aug. 7, 2012

(54) DISCHARGE DEVICE AND IMAGE FORMING APPARATUS

(75) Inventors: Shinji Masaki, Ebina (JP); Kouichi Kumeta, Ebina (JP); Satoshi Fukada, Ebina (JP); Masahiro Mori, Ebina (JP); Tomonori Ishikawa, Ebina (JP); Go Kondoh, Ebina (JP); Masashi Ikeda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 241 days.

(21) Appl. No.: 12/120,291

(22) Filed: May 14, 2008

(65) Prior Publication Data

US 2009/0116883 A1 May 7, 2009

(30) Foreign Application Priority Data

Nov. 7, 2007 (JP) ..... 2007-290140

(51) Int. Cl.
*B65H 29/70* (2006.01)

(52) U.S. Cl. ..... 271/188; 271/209

(58) Field of Classification Search ..... 271/188, 271/209

See application file for complete search history.

(56) References Cited

U.S. PATENT DOCUMENTS

| | | | | | |
|---|---|---|---|---|---|
| 1,891,286 | A * | 12/1932 | Miersch | 271/188 |
| 3,934,872 | A * | 1/1976 | Honkawa | 271/188 |
| 4,234,305 | A * | 11/1980 | Miyake et al. | 432/59 |
| 4,354,408 | A * | 10/1982 | Carte | 83/162 |
| 4,605,211 | A * | 8/1986 | Sonobe | 270/58.17 |
| 5,016,867 | A * | 5/1991 | Kamath | 271/209 |
| 5,091,754 | A * | 2/1992 | Abe et al. | 399/394 |
| 5,092,696 | A * | 3/1992 | Armiroli et al. | 400/611 |
| 5,603,493 | A * | 2/1997 | Kelly | 271/188 |
| 6,042,106 | A * | 3/2000 | Kelly et al. | 271/188 |
| 6,089,567 | A * | 7/2000 | Yatsuhashi et al. | 271/314 |
| 6,701,841 | B2 * | 3/2004 | Tsurumaki | 101/419 |
| 6,752,553 | B2 * | 6/2004 | Fujioka | 400/642 |
| 6,776,408 | B2 * | 8/2004 | Suzuki et al. | 271/188 |
| 6,896,432 | B2 * | 5/2005 | Ohyama | 400/642 |
| 7,686,295 | B2 * | 3/2010 | Kawaguchi et al. | 271/188 |
| 2008/0191410 | A1 * | 8/2008 | Shinohara | 271/209 |

FOREIGN PATENT DOCUMENTS

| | | | |
|---|---|---|---|
| JP | 63-161263 | U | 10/1988 |
| JP | 5-124764 | A | 5/1993 |
| JP | 6-100226 | A | 4/1994 |
| JP | 2001-31312 | A | 2/2001 |
| JP | 2002-37502 | A | 2/2002 |
| JP | 2003-40506 | A | 2/2003 |
| JP | 2006-82899 | A | 3/2006 |

OTHER PUBLICATIONS

Notification of Reasons for Refusal issued Apr. 3, 2012 by the Japanese Patent Office in counterpart Japanese Application No. 2007-290140.

* cited by examiner

*Primary Examiner* — Michael McCullough
*Assistant Examiner* — Howard Sanders
(74) *Attorney, Agent, or Firm* — Sughrue Mion, PLLC

(57) ABSTRACT

A discharge device includes: a discharge unit that discharges a recording medium in a discharge direction; and a forming unit arranged downstream of the discharge unit and adapted to form an oblique corrugation with respect to the discharge direction on the recording medium.

4 Claims, 10 Drawing Sheets

DISCHARGE DEVICE AND IMAGE FORMING APPARATUS

CROSS-REFERENCE TO RELATED APPLICATION

This application is based on and claims priority under 35 USC §119 from Japanese Patent Application No. 2007-290140 filed Nov. 7, 2007.

BACKGROUND (i) Technical Field

The present invention relates to a discharge device and an image forming apparatus.

(ii) Related Art

A discharge device in the related art discharges a paper to a discharged part while guiding the paper with a guide, and discharges the paper to the discharged part byway of a discharge mechanism. Such a discharge device is included in an image forming apparatus or the like. In an image forming apparatus in the related art, a toner image is formed on a photoreceptor drum on which a latent image is optically formed, the toner image is primarily transferred onto a transfer belt, and the primary transferred image on the transfer belt is secondarily transferred onto a paper. Then, the secondary transfer image on the paper is fixed on the paper, and the paper is discharged to a discharged part outside the apparatus by way of a discharge device.

In this way, in an image forming apparatus in the related art, when a paper is discharged to a discharged part outside the image forming apparatus, the front end of the paper, which is not stiff enough, may sag and curl in the paper discharge direction, thus causing storage failure of papers. In order to prevent such storage failure, a paper is waved in a direction orthogonal to the paper discharge direction by a discharge mechanism to discharge the paper on which a protrusion corrugation is formed. The paper with a corrugation formed thereon may come into contact with a guide and generate scratch noise.

SUMMARY

There is provided a discharge device including:

a discharge unit that discharges a recording medium in a discharge direction; and a forming unit arranged downstream of the discharge unit and adapted to form an oblique corrugation with respect to the discharge direction on the recording medium.

BRIEF DESCRIPTION OF THE DRAWINGS

Embodiments of the present invention will be described in detail based on the following figures, wherein.

DETAILED DESCRIPTION

(1) First Embodiment

Figure 1:
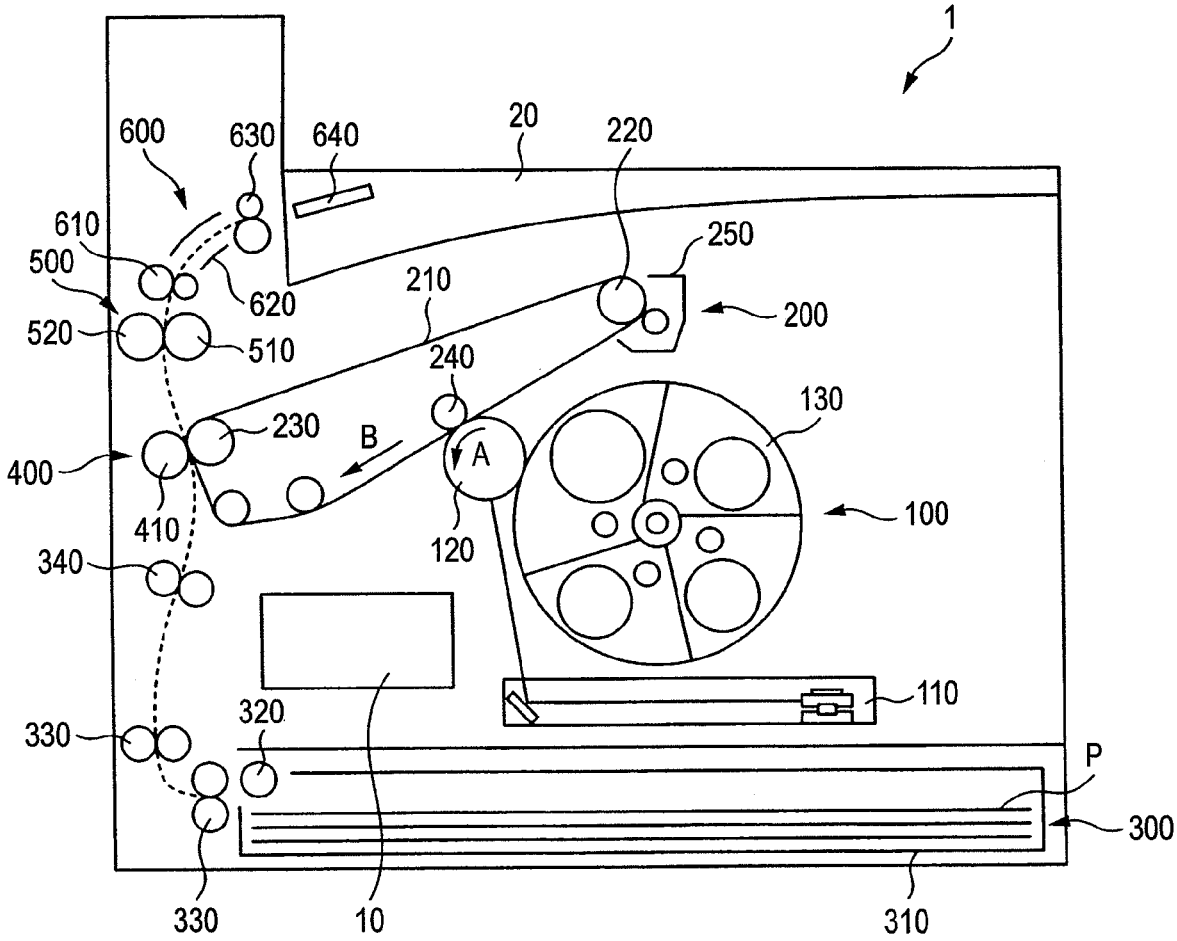
FIG. 1 is a schematic view of a color printer according to an exemplary embodiment of the invention.

An exemplary embodiment of the invention will be described referring to figures. FIG. 1 is a schematic view of a color printer according to an exemplary embodiment of the invention.

(Composition of Color Printer)

Referring to FIG. 1, a numeral 1 represents a color printer (image forming apparatus). The color printer 1 includes a controller 10, an image forming unit 100, a primary transfer device 200, a paper feeder 300, a secondary transfer device 400, a fixing device 500, and a paper discharge device (discharge device) 600. The color printer 1 prints an image composed of color components of four colors, cyan (C), magenta (M), yellow (Y) and black (K) overlapped one on the other on a paper (a recording medium) P.

The color printer 1 receives, on the controller 10, image data from an image output device (not shown) such as a personal computer or an image reader via a communication circuit. The controller 10 issues an image forming control command to the image forming unit 100 based on the supplied image data. The controller 10 controls operations of the entire color printer 1 including the image forming operation.

The image forming unit 100 includes a laser optical scanner 110 for scanning a laser beam in accordance with image data supplied from the controller 10 and a photoreceptor drum 120 which is arranged above the laser optical scanner 110 and on which an electrostatic latent image is formed by way of a laser beam scanned by the laser optical scanner 110. The laser optical scanner 110 deflects and scans the laser beam modulated in accordance with image data of respective colors and irradiates the resulting laser beam onto the photoreceptor drum 120.

The photoreceptor drum 120 rotates in the direction of an arrow A. On the periphery of the photoreceptor drum 120 are arranged a cleaning unit (not shown) for cleaning the surface of the photoreceptor drum 120, a charger (not shown) for charging the surface of the photoreceptor drum 120, and a developer 130 for developing an electrostatic latent image formed on the photoreceptor drum 120 in this order along the direction of the arrow A.

In the image forming unit 100, the rotating photoreceptor drum 120 is charged by the charger (not shown) and a laser beam is irradiated onto the surface of the photoreceptor drum 120 from the laser optical scanner 110. This forms an electrostatic latent image corresponding to image data of respective colors. When the electrostatic latent image passes through the developer 130, toner is supplied from the developer 130 onto the surface of the photoreceptor drum 120. Toner is left on the electrostatic latent image alone on the surface and the toner image is developed.

Next, the toner image on the photoreceptor drum 120 is primarily transferred onto the circularly rotating transfer belt 210 along the direction of the arrow B of a primary transfer device 200. After the primary transfer, toner remains on the surface of the photoreceptor drum 120. The residual toner is scraped off the surface of the photoreceptor drum 120 by the cleaning unit (not shown).

As described above, the primary transfer device 200 receives a toner image on the transfer belt 210 from the photoreceptor drum 120 to perform the process of primary transfer. On the transfer belt 210 of the primary transfer device 200 are multi-transferred toner images of respective colors. The transfer belt 210 is wound around a driving roll 220 and a backup roll 230 under a predetermined tension and is circularly rotated in the direction of an arrow B at a constant speed by the driving roll 220.

Between the inner circumference of the transfer belt 210 and the photoreceptor drum 120 is rotatably arranged, with a transfer belt 210 placed in between, a primary transfer roll 240 rotating together with the photoreceptor drum 120. In a position opposed to the driving roll 220 with the transfer belt 210 placed in between, a belt cleaner 250 is provided for cleaning the surface of the transfer belt 210. The belt cleaner 250 scrapes toner remaining on the surface of the transfer belt 210.

The paper feeder 300 includes a paper storage part 310 in which numerous sheets of paper P are loaded, an extracting roll 320 for pulling out a sheet of paper P from the paper storage part 310, a plurality of conveying roll pairs 330 arranged apart from each other toward the secondary transfer device 400, and a resist roll pair 340 for feeding paper into the secondary transfer device 400 with a timing. The paper feeder 300 conveys the paper P drawn from the paper storage part 310 toward the secondary transfer device 400.

The secondary transfer device 400 includes, a secondary transfer roll 410 rotating together with the backup roll 230 under a transfer pressure, between the secondary transfer device 400 and the backup roll 230, with the transfer belt 210 placed in between. In the secondary transfer device 400, the paper P conveyed from the paper storage part 310 is inserted between the secondary transfer roll 410 and the transfer belt 210 in timing with the toner image on the transfer belt 210, and the toner image is secondarily transferred onto the surface of the paper P. The paper P subjected to secondary transfer is carried to the fixing device 500.

The fixing device 500 includes a heating roll 510 and a pressure roll 520. As paper P is conveyed while being heated and pinched hard between the heating roll 510 and the pressure roll 520, a secondary transfer image is fixed onto the surface of the paper P. The paper P with the secondary transfer image fixed thereon is carried to the paper discharge device 600. The paper discharge device 600 discharges the paper P carried from the fixing device 500 to a discharged part 20 described later. The paper discharge device 600 will be detailed later.

(Operation of Color Printer)

Next, operation of the color printer 1 will be described. The color printer 1 primarily transfers onto the transfer belt 210, in a sequential way, toner images of respective colors of C, M, Y and K formed on the surfaces of respective photoreceptor drums 120. The color printer 1 secondarily transfers, by way of the secondary transfer device 400, the primary transfer image on the transfer belt 210 onto the paper P carried from the paper feeder 300. The color printer 1 feeds the paper P to the fixing device 500 and fixes the secondary transfer image onto the paper P. The paper P on which the secondary transfer image is fixed is discharged to the discharged part 20 by the paper discharge device 600.

(Composition of Paper Discharge Device)

Figure 2:
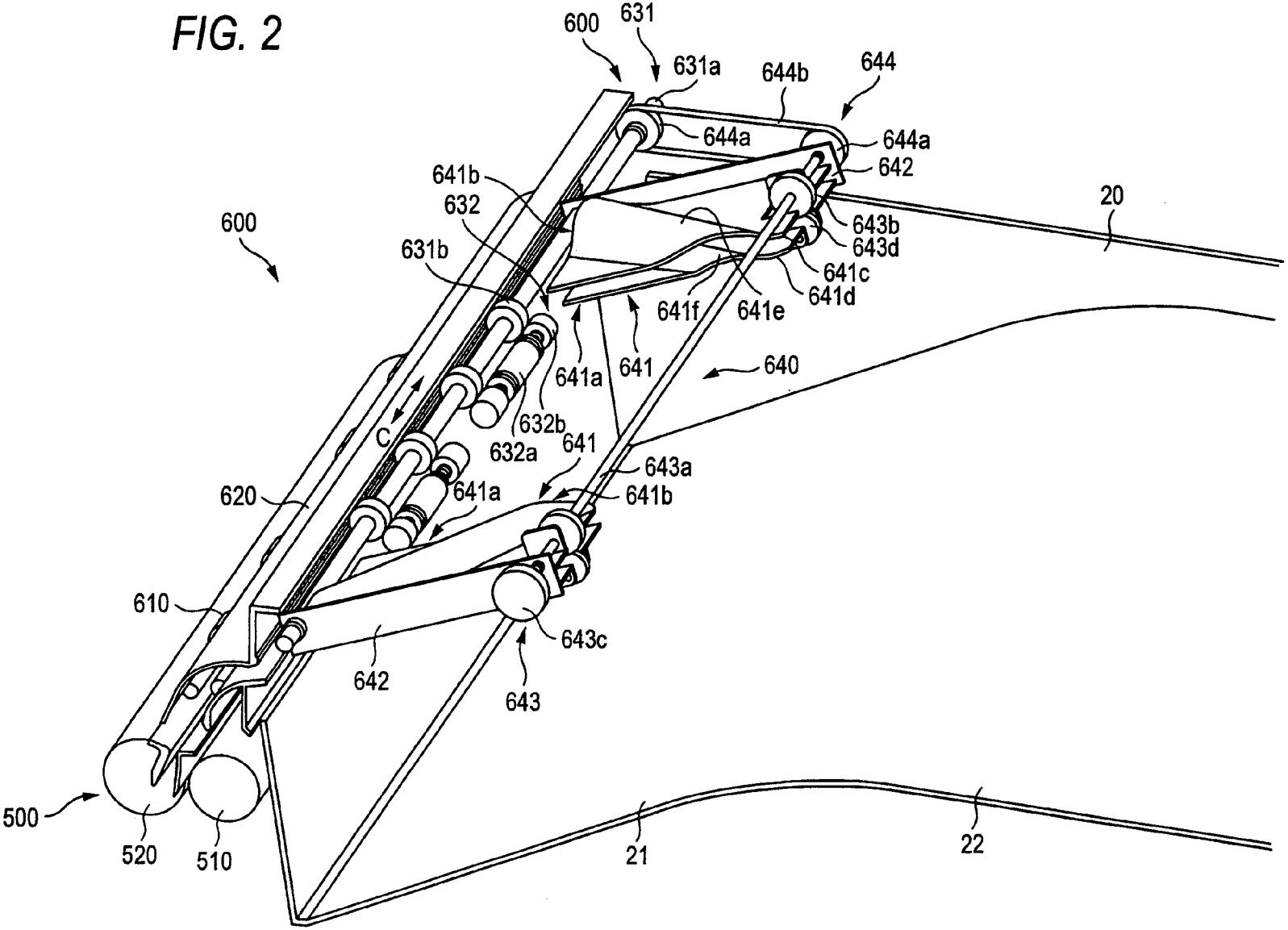
FIG. 2 is a perspective view of a paper discharge device.
Figure 3:
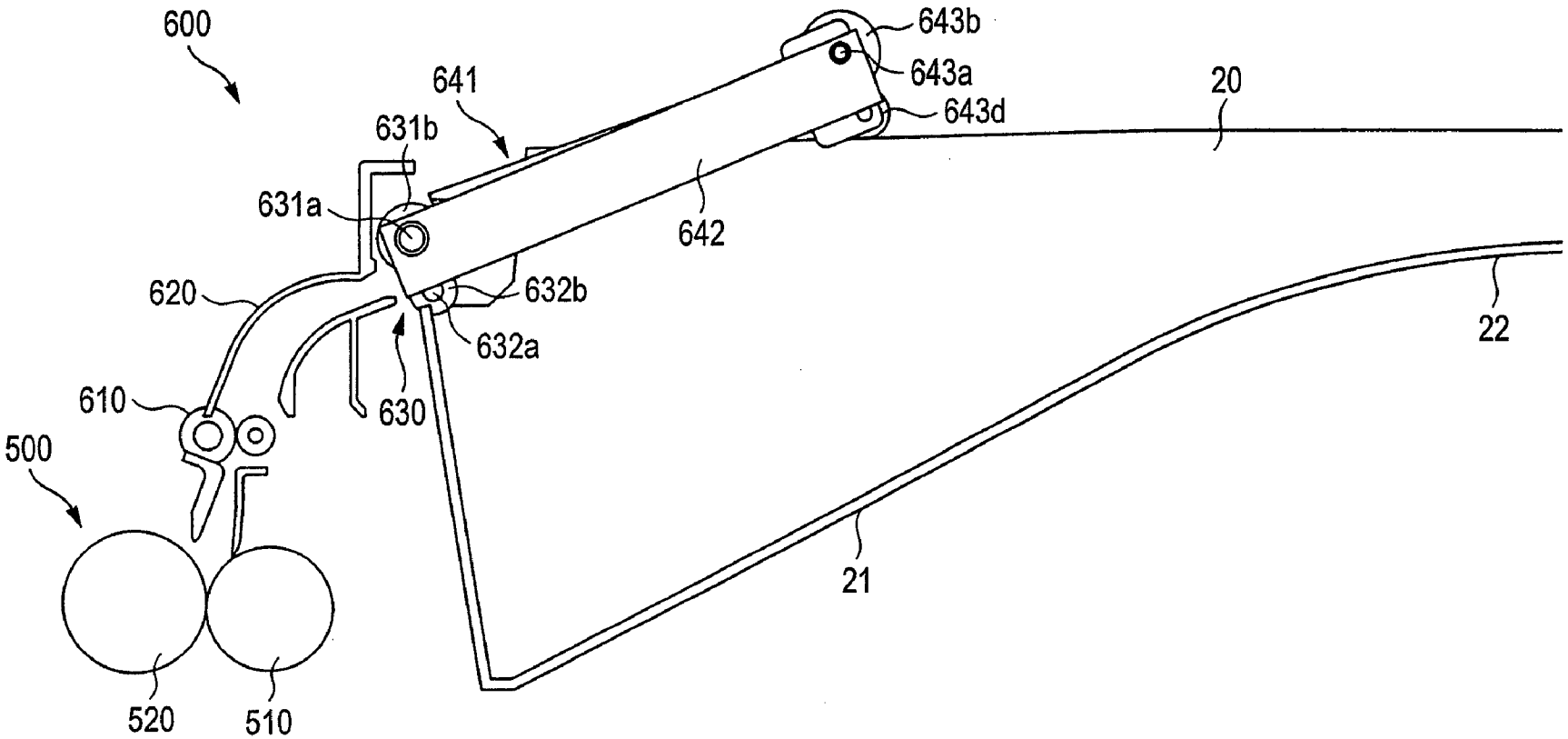
FIG. 3 is a side view of the paper discharge device.
Figure 4:
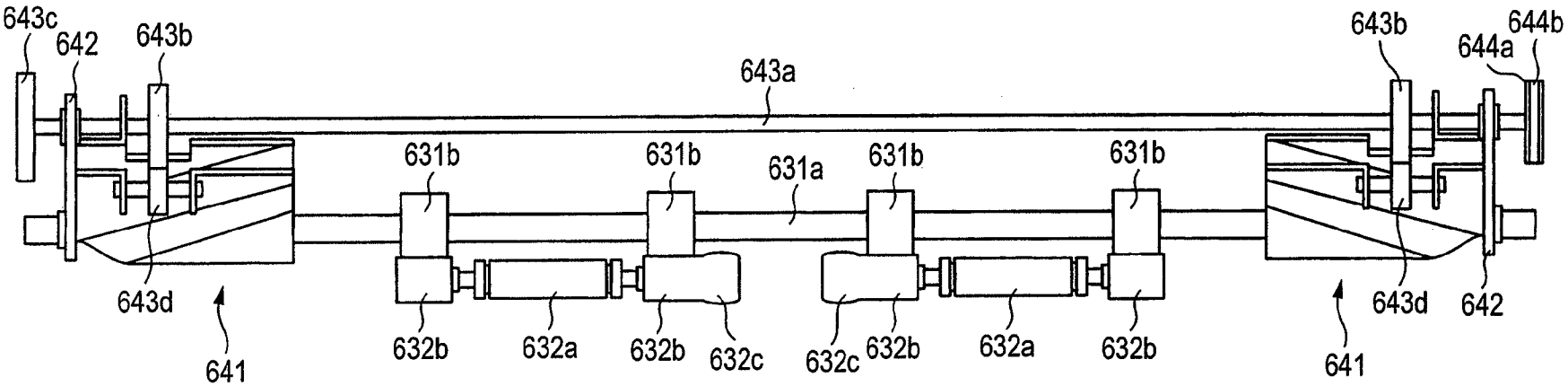
FIG. 4 shows the paper discharge device viewed from the paper discharge direction.
Figure 5:
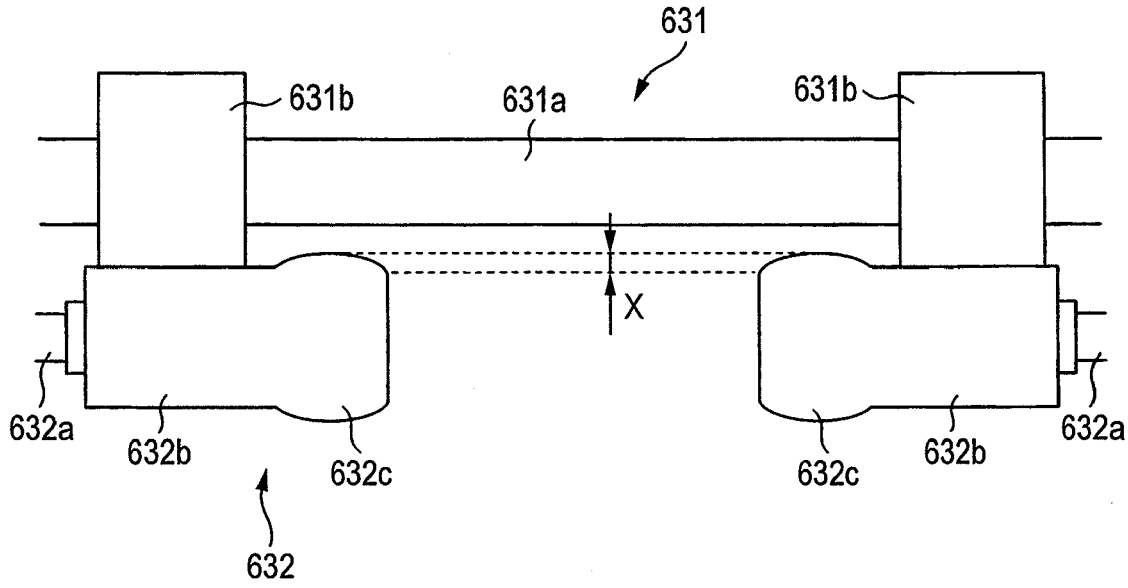
FIG. 5 is an enlarged view of a discharge mechanism.
Figure 6:
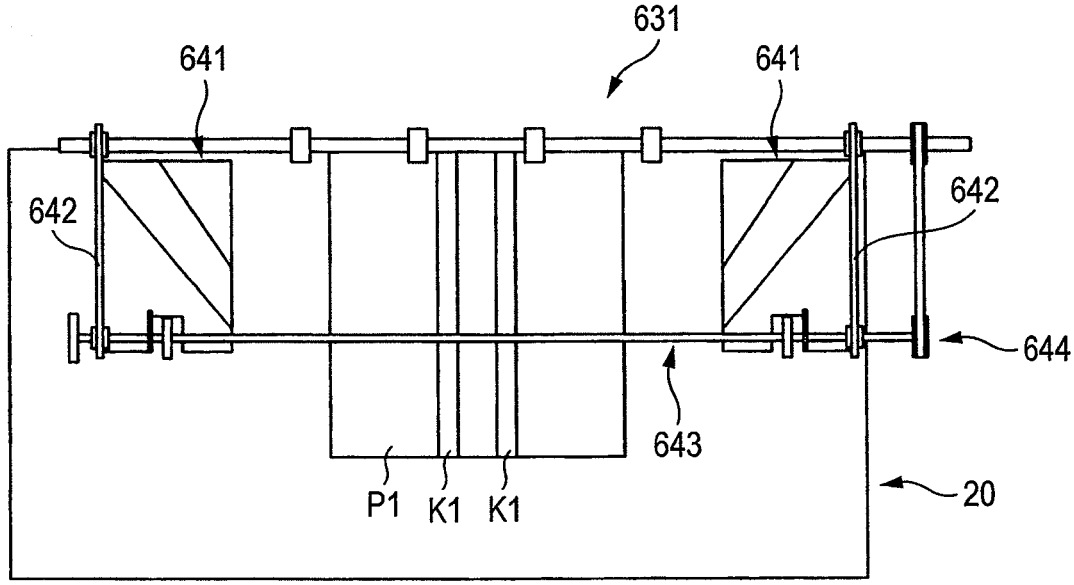
FIG. 6 is a top view of the paper discharge device when a small-size paper is discharged.
Figure 7:
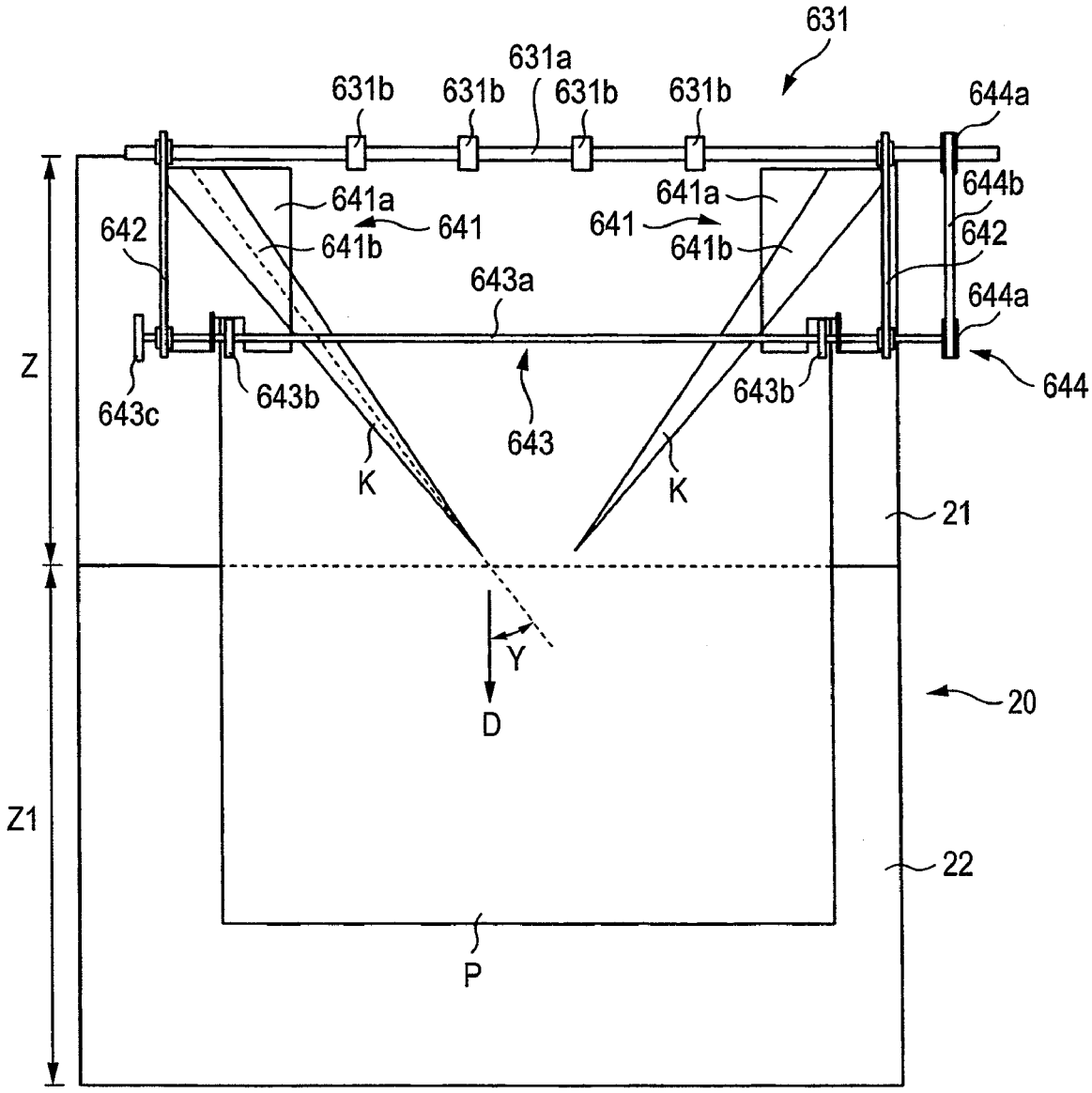
FIG. 7 is a top view of the paper discharge device when a paper is discharged.
Figure 8:
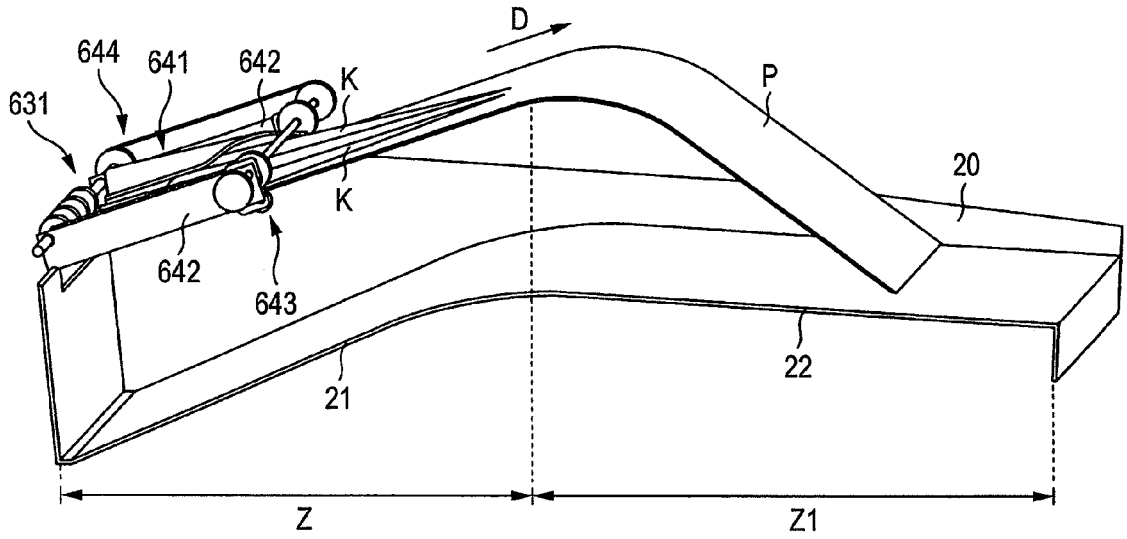
FIG. 8 is a perspective view of the paper discharge device when a paper is discharged.
Figure 9:
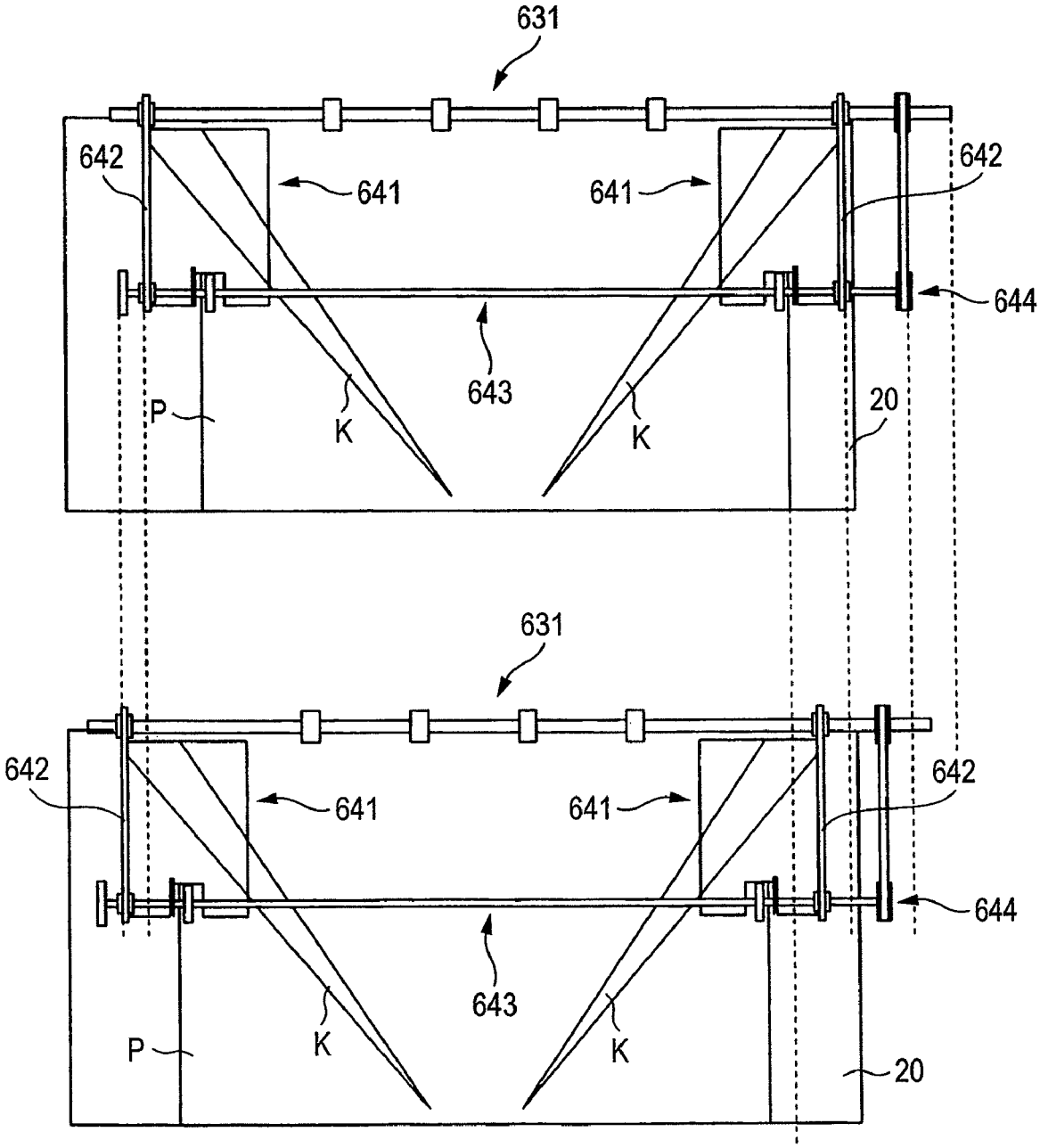
FIG. 9 is a conceptual diagram showing a case where the discharge mechanism moves laterally.

The composition of the paper discharge device 600 will be described referring to figures. FIG. 2 is a perspective view of a paper discharge device. FIG. 3 is a side view of the paper discharge device. FIG. 4 shows the paper discharge device viewed from the paper discharge direction. FIG. 5 is an enlarged view of a discharge mechanism. FIG. 6 is a top view of the paper discharge device when a small-size paper is discharged. FIG. 7 is a top view of the paper discharge device when a paper is discharged. FIG. 8 is a perspective view of the paper discharge device when a paper is discharged. FIG. 9 is a conceptual diagram showing a case where the discharge mechanism moves laterally. In FIG. 3, the knob 643*c* of an assisting mechanism 643 described later is not shown.

As shown in FIG. 2, the paper discharge device 600 includes a discharged part 20, a conveying roll pair 610, a guide 620, a discharge mechanism (discharge unit) 630, and a waving forming device 640. The paper discharge device 600 conveys paper P conveyed by the conveying roll pair to the discharge mechanism 630 while guiding the paper P with the guide 620. The paper discharge device 600 forms a corrugation K on the paper P discharged by the discharge mechanism 630 by way of the waving forming device 640. The paper discharge device 600 then discharges the paper P on which the corrugation K is formed to the discharged part 20. The direction the paper P is conveyed by the conveying roll pair 610 and discharged to the discharged part 20 is the paper discharge direction (discharge direction).

As shown in FIG. 3, the discharged part 20 includes an inclined part 21 designed to align discharged sheets of paper P by the dead weight of the paper P and a flat part 22. The inclined part 21 is arranged closer to the discharge mechanism 630 than the flat part 22. The inclined part 21 tilts downward in the direction of the discharge mechanism 630 from the flat part 22.

The conveying roll pair 610 conveys the paper P on which a secondary transfer image is fixed by the fixing device 500 to the discharge mechanism 630. The guide 620 as a guide unit forms a curved guiding path as shown in FIG. 3. The guide 620 guides the paper P to the discharge mechanism 630 while the paper P is being conveyed.

As shown in FIG. 2, the discharge mechanism 630 includes a driving member 631 and a pinch member 632. The discharge mechanism 630 pinches the paper P conveyed by the conveying roll pair 610 with the driving member 631 and the pinch member 632 and discharges the paper P to the discharged part 20. The driving member 631 includes a rotary shaft 631*a* and a driving roll 631*b* as shown in FIG. 2. The driving member 631 fixes a plurality of driving rolls 631*b* on the rotary shaft 631*a* in a transfixing form.

The rotary shaft 631*a* is fixed to a lateral movement device (not shown). Thus the rotary shaft 631*a* moves in lateral direction (in the direction of an arrow C in FIG. 2) with respect to the paper discharge direction. The rotary shaft 631*a* is fixed to a rotary driving device (not shown). Thus the rotary shaft 631*a* rotates. Into the rotary shaft 631*a* is inserted the side plate (movement unit) 642 of a waving forming device 640 described later. To the rotary shaft 631*a* is fixed the coordinating roll 644*a* of a power transmitting member (transmitting unit) 644 described later. As shown in FIG. 9, when paper P is discharged to the discharged part 20 by the driving member 631, the rotary shaft 631*a* rotates and moves in the direction of the arrow C and discharges the paper P in different phases in the width direction of the discharged part 20.

The pinch member 632 includes a shaft 632*a* and a pinch roll 632*b*. The pinch member 632 fixes a plurality of pinch rolls 632*b* on the shaft 632*a* in a transfixing form. The pinch rolls 632*b* are arranged in positions opposed to the driving rolls 631*b*. The pinch roll 632*b* of the pinch member 632 rotates as paper P is pinched by the driving rolls 631*b* and pinch roll 632*b* and discharges the paper P.

As shown in FIGS. 4 and 5, the pinch roll 632*b* includes a third protrusion part 632*c*. The height X of the third protrusion part 632*c* is about 0.2 mm. As shown in FIG. 6, the third protrusion part 632*c* forms, by way of the forming chute (forming unit) 641 of a waving forming device 640 described later, a corrugation (first corrugation) K1 on paper (first recording medium) P1 without a corrugation K formed thereon. In other words, the third protrusion part 632*c* forms a corrugation K1 on paper P1 smaller than the paper P on which a corrugation K is formed by the forming chute 641.

The third protrusion part 632*c* forms a corrugation K1 on paper P also. The corrugation K1 is one not involving scratch noise. That is, the corrugation K1 is formed on paper P or paper P1 upstream of the discharge mechanism 630 in the paper discharge direction. In this case, the corrugation K1 is smaller than the corrugation K so that scratch noise does nor occur caused by contact between the paper P or paper P1 and the guide 620.

The corrugation K1 may be made smaller than the corrugation K because it suffices to form an effective corrugation with respect to paper P1. That is, the corrugation K1 is not an effective corrugation with respect to paper P. Thus, the third protrusion part 632*c* may have a size corresponding to a corrugation K1 to be formed that is smaller than the corrugation K.

As shown in FIG. 2, the waving forming device 640 includes forming chutes 641, side plates 642, an assisting mechanism (assisting unit) 643, and a power transmitting member 644. The waving forming device 640 forms a corrugation K on the paper P discharged by the discharge mechanism 630 by way of the forming chutes 641 moved with the movement of the discharge mechanism 630 by the side plates 642 and assists discharge of paper P by the discharge assisting mechanism 643 to which power is transmitted by the power transmitting member 644.

As shown in FIGS. 2 and 4, the forming chutes 641 are fixed to the side plates 642 of the waving forming device 640 described later. The forming chutes 641 are arranged in positions corresponding to both ends of the paper P to be discharged. The paper P thus has two corrugations K formed thereon. The forming chutes 641 do not come into contact with paper P1 that is smaller than paper P and do not form a corrugation K on the paper P1. That is, paper P1 that is smaller than paper P does not come into contact with the forming chutes 641 and does not have a corrugation K formed thereon.

As shown in FIG. 2, each forming chute 641 includes a guiding part 641*a* and a forming part 641*b*. The forming chute 641 guides paper P by way of the guiding part 641*a* and forms an oblique corrugation K with respect to the paper discharge direction on the guided paper P by way of the forming part 641*b*.

As shown in FIG. 2, the guiding part 641*a* is formed by a first plate member 641*c* and a second plate member 641*d*. The guiding part 641*a* is arranged and formed so that the first plate member 641*c* on the upper side and the second plate member 641*d* on the lower side will have a predetermined spacing therebetween. Paper P passes through the predetermined spacing. The predetermined spacing has a size that allows the paper P to pass through the same. The guiding part 641*a* guides the paper P as the paper P passes through the predetermined spacing. The first plate member 641*c* includes a first protrusion part 641*e*. The second plate member 641*d* includes a second protrusion part 641*f*.

As shown in FIG. 2, the forming part 641*b* is formed by the first protrusion part 641*e* and the second protrusion part 641*f*. The forming part 641*b* has a shape of an upwardly protruding hemicone. That is, each of the first protrusion part 641*e* and the second protrusion part 641*f* has a shape of an upwardly protruding hemicone. The forming part 641*b* is formed so that the first protrusion part 641*e* will be arranged in a position a predetermined spacing away from and opposed to the second protrusion part 641*f*.

As shown in FIG. 7, the forming parts 641*b* are arranged obliquely with respect to the paper discharge direction. Both forming parts 641*b* are arranged in a slanted shape protrusion in the paper discharge direction. That is, the forming parts 641*b* are arranged at a predetermined angle Y with respect to the paper discharge direction (direction of an arrow D). The forming parts 641*b* form wave-shaped corrugations K on paper P as the paper P passes through the spacing between the first protrusion part 641*e* and the second protrusion part 641*f*. Corrugations K are not formed on the paper P passing through the guide 620.

As shown in FIGS. 7 and 8, the corrugations K formed on paper P has a shape of a truncated chevron in the paper discharge direction. In other words, corrugations K of a slanted shape are formed since both forming parts 641*b* are arranged in a slanted shape protrusion in the paper discharge direction.

The corrugations K formed on paper P is formed in a region Z corresponding to the inclined part 21. That is, the forming parts 641*b* are arranged at a predetermined angle Y with respect to the paper discharge direction (direction of an arrow D). The predetermined angle Y is determined by the distance of the inclined part 21 in the paper discharge direction, that is, the distance of the region Z. For example, the shorter the distance of the inclined part 21 becomes, the larger the predetermined Y angle becomes. The longer the distance of the inclined part 21 becomes, the smaller the predetermined angle Y becomes.

As shown in FIG. 8, corrugations K are formed on paper P passing through the region Z. Corrugations K are not formed on the paper P that has passed the region Z. Once the paper P has passed through the region Z, the corrugations K formed on the paper P disappear. When the corrugations K disappear, the paper P sags. This process prevents storage failure of paper P. In other words, the position where the paper P sags is a region Z1 corresponding to the flat part 22 of the discharged part 20. This prevents storage failure of paper P.

The corrugations K formed on paper P do not come into contact with the driving member 631 of the discharge mechanism 630. The forming chutes 641 are arranged respectively in positions corresponding to both ends of paper P. The forming parts 641*b* are arranged at a predetermined angle Y with respect to the paper discharge direction (direction of an arrow D), which keeps the corrugations K off the driving member 631. As a result, corrugations K are not formed on paper P passing through the guide 620.

The corrugations K formed on paper P do not come into contact with each other. The forming part 641*b* on the downstream side in the paper discharge direction has a hemicone shape of a larger diameter than the forming part 641*b* on the upstream side in the paper discharge direction. Corrugations K disappear before they come into contact with each other. Thus, the corrugations K do not come into contact with each other.

The side plate 642 includes a first opening (not shown) and a second opening (not shown). As shown in FIG. 7, the side plate 642 inserts a rotary shaft 631*a* rotatably into the first opening (not shown) and inserts the rotary shaft 643*a* of an assisting mechanism 643 described later into the second opening (not shown). The side plate 642 has a forming chute 641 fixed thereto. The side plate 642 moves as the rotary shaft 631*a* of the discharge mechanism 630 moves in the direction of an arrow C in FIG. 2. As shown in FIG. 9, the side plate 642 moves the forming chute 641 and the rotary shaft 643*a* of the assisting mechanism 643 described later as the rotary shaft 631*a* moves in the direction of the arrow C. In other words, the side plate 642 moves the waving forming device 640 in accordance with the movement of the discharge mechanism 630.

As shown in FIG. 2, the assisting mechanism 643 is arranged at the front end of the forming chute 641 in the paper discharge direction. That is, the assisting mechanism 643 is arranged downstream of the discharge mechanism 630 in the paper discharge direction. The assisting mechanism 643 includes a rotary shaft 643*a*, assisting rolls (rotary unit) 643*b*, a knob 643*c*, and rolls 643*d*. The assisting mechanism 643 fixes, in a transfixing form, the assisting rolls 643*b* to the rotary shaft 643*a* arranged laterally with respect to the paper discharge direction in positions corresponding to both ends of paper P to be discharged.

The rotary shaft 643*a* is arranged so as not to come into contact with the corrugations K formed on paper P as shown in FIG. 8. Contact is avoided by adjusting the diameter of the assisting roll 643*b* or the size of the corrugations K formed on paper P. To one end of the rotary shaft 643*a* is fixed the knob 643*c*. The knob 643*c* is used to discharge paper P by turning the same upon jamming of the paper P. At the other end of the rotary shaft 643*a* is fixed the coordinating roll 644*a* of a power transmitting member 644 described later. Power is thus transmitted to rotate the rotary shaft 643*a*.

The roll 643*d* is arranged in a position opposed to the assisting roll 643*b*. The roll 643*d* and the assisting roll 643*b* pinch and convey paper P. The rotary shaft 643*a* is rotated by the power transmitting device 644 described later and the assisting roll 643*b* and the roll 643*d* pinch and convey paper P. In this way, the assisting mechanism 643 assists discharge of the paper P.

The arrangement where the assisting mechanism 643 does not come into contact with corrugations K is not limited to this embodiment. For example, an embodiment may be employed where rotary shafts are separately provided to the assisting rolls 643*b* in positions corresponding to both ends of paper P and each of the rotary shafts is equipped with the coordinating roll 644*a* of the power transmitting member 644 described later.

As shown in FIG. 2, the power transmitting member 644 includes coordinating rolls 644*a* and a belt 644*b*. The coordinating rolls 644*a* form a pair. One coordinating roll 644*a* is fixed to the rotary shaft 631*a* of the driving member 631. The other coordinating roll 644*a* is fixed to the rotary shaft 643*a* of the assisting mechanism 643. The belt 644*b* is hung around the pair of coordinating rolls 644*a*. When the rotary shaft 631*a* of the driving member 631 rotates, the power transmitting member 644 transmits the power of the driving member 631 to the assisting mechanism 643 by way of the coordinating rolls 644*a* and the belt 644*b*.

(Operation of Paper Discharge Device)

Next, operation of a paper discharge device 600 will be described referring to FIGS. 10 and 11. FIGS. 10A-10C are perspective views showing the operation of a paper discharge device. FIGS. 11A-11C show the operation of the paper discharge device.

Figure 10A:
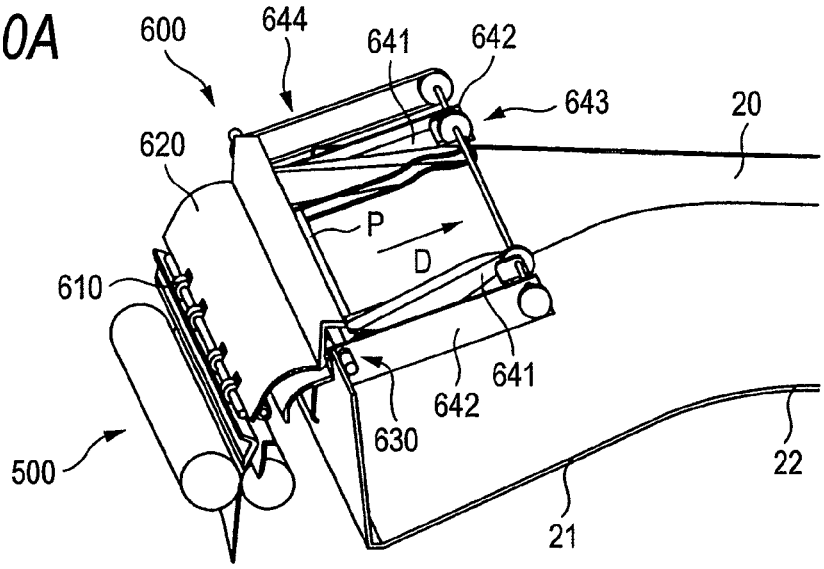
FIGS. 10A-10C are perspective views showing the operation of a paper discharge device.
Figure 11A:
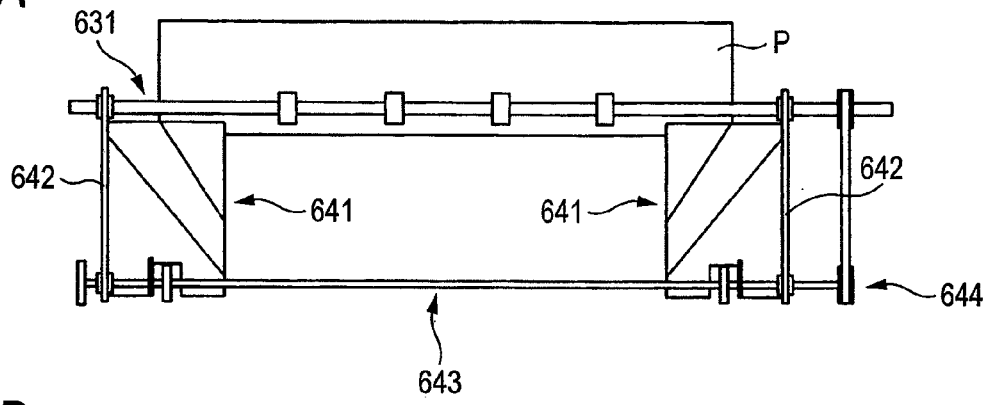
FIGS. 11A-11C show the operation of the paper discharge device.

As shown in FIG. 10A, the paper discharge device 600 conveys paper P on which a secondary transfer image is fixed by a fixing device 500 to a discharge mechanism 630 by way of a pair of conveying rolls 610 while guiding the paper P with a guide 620. The paper discharge device 600 discharges the conveyed paper P in the direction of an arrow D by way of the discharge mechanism 630, and engages the guiding part 641*a* of the forming chute 641 to cause the discharged paper P to pass through a forming part 641*b*.

Figure 10B:
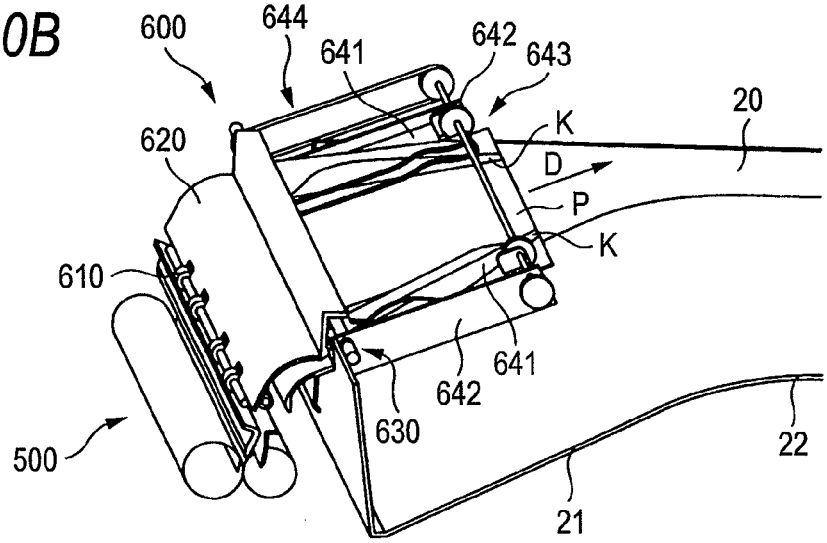
Figure 10C:
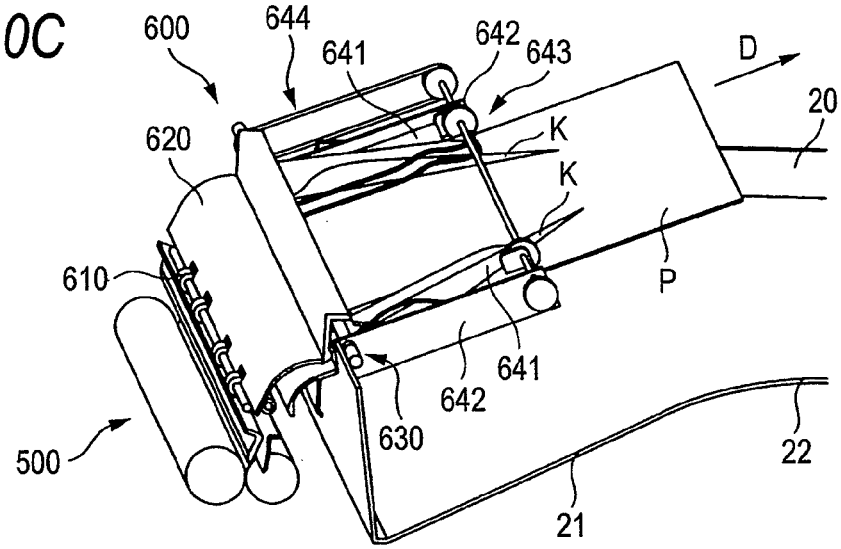
Figure 11B:
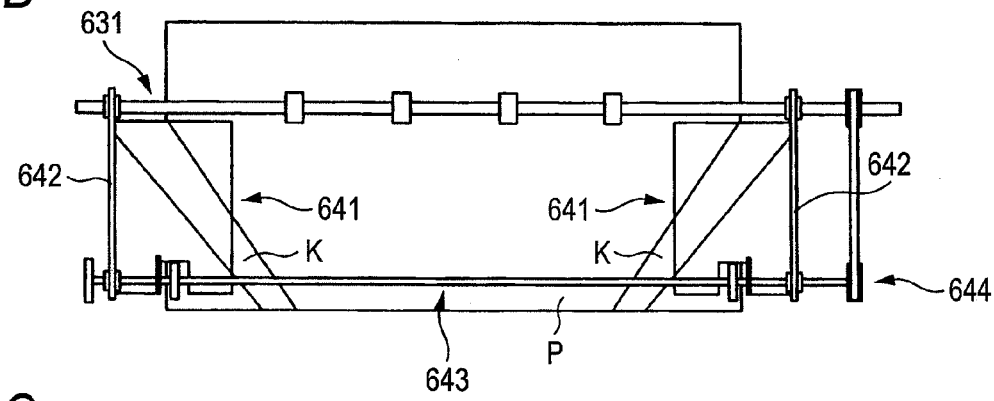
Figure 11C:
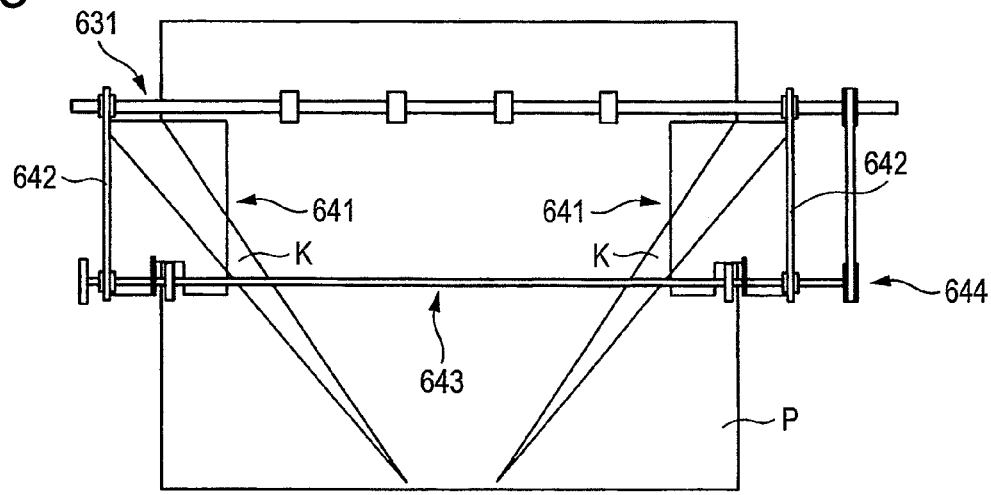

As shown in FIGS. 10B and 11B, at this time, the paper discharge device 600 forms corrugations K of a slanted shape on paper P. The paper discharge device 600 is assisted in discharging the front end of the paper P in the paper discharge direction by the assisting mechanism 643 to which power is transmitted by the discharge mechanism 630. When the paper P is further discharged in the direction of an arrow D, corrugations K are formed on the paper P as shown in FIGS. 10C and 11C.

The paper discharge device 600 is assisted in discharging the front end of paper P in the paper discharge direction by the assisting mechanism 643, thus further discharging the paper P. At this time, as shown in FIG. 8, no corrugations K are formed on paper P that has passed through a region Z. In other words, once paper P has passed through the region Z, the corrugations K formed on the paper P disappear and the paper P sags. The front end of the paper P comes into contact with the flat part 22 of the discharged part 20 in the paper discharge direction and the paper P is discharged to the discharged part 20.

Paper P1 that is smaller than paper P is conveyed to the discharge mechanism 630 by way of a pair of conveying rolls 610 while being guided by a guide 620. Corrugations K1 are formed on the conveyed paper P1 by way of the discharge mechanism 630. The paper P1 is then discharged to the discharged part 20.

The invention is applicable to image forming apparatuses including discharge devices for discharging paper, color printers, facsimiles, color copiers, or devices equipped with functions of these devices.

What is claimed is:

1. A discharge device comprising:

a discharge unit that discharges a recording medium in a discharge direction onto a discharged part;

a forming unit arranged downstream of the discharge unit and adapted to form an oblique corrugation with respect to the discharge direction on the recording medium; and a moving unit that moves the forming unit in a moving direction of the discharge unit as the discharge unit moves with respect to the discharged part in a direction perpendicular to the discharge direction, wherein the forming unit includes a guiding part that guides the recording medium and a forming part that forms the oblique corrugation on the recording medium guided by the guiding part, wherein the forming part is formed in a hemicone shape.

2. The discharge device according to claim 1, wherein a curvature radius of the forming part at a downstream side of the forming part in the discharge direction is larger than a curvature radius of the forming part at an upstream side of the forming part in the discharge direction.

3. The discharge device according to claim 1, further comprising a discharge part in which the recording medium is discharged, the discharge part including an inclined part, wherein the oblique corrugation is formed on a region of the recording medium corresponding to a top portion of the forming part.

4. A discharge device comprising:

a discharge unit that discharges a recording medium in a discharge direction onto a discharged part;

a forming unit arranged downstream of the discharge unit and adapted to form an oblique corrugation with respect to the discharge direction on the recording medium; and a moving unit that moves the forming unit in a moving direction of the discharge unit as the discharge unit moves with respect to the discharged part in a direction perpendicular to the discharge direction, wherein the forming unit includes a guiding part that guides the recording medium and a forming part that forms the oblique corrugation on the recording medium guided by the guiding part, wherein the guiding part includes a first plate member and a second plate member arranged so as to have a spacing between the first plate member and the second plate member, the forming part includes a first protrusion part arranged on the first plate member and obliquely with respect to the discharge direction, and a second protrusion part arranged on the second plate member and obliquely with respect to the discharge direction, and the first protrusion part and the second protrusion part are arranged opposite to each other with a spacing therebetween, wherein the first protrusion part is formed in a hemicone shape, and the second protrusion part is formed in a hemicone shape.

* * * * *